US007686299B2

(12) United States Patent
Herrmann

(10) Patent No.: US 7,686,299 B2
(45) Date of Patent: Mar. 30, 2010

(54) REGISTRATION CARRIAGE NIP RELEASE WITH REDUCED REACTION FORCES

(75) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 12/146,854

(22) Filed: Jun. 26, 2008

(65) Prior Publication Data

US 2009/0322016 A1 Dec. 31, 2009

(51) Int. Cl.
*B65H 7/02* (2006.01)

(52) U.S. Cl. ..... 271/249; 271/228

(58) Field of Classification Search ..... 271/226, 271/253, 249, 248, 228, 273
See application file for complete search history.

(56) References Cited

U.S. PATENT DOCUMENTS

| | | | | |
|---|---|---|---|---|
| 6,736,394 | B2 * | 5/2004 | Herrmann et al. | 271/249 |
| 7,530,256 | B2 * | 5/2009 | deJong et al. | 73/1.37 |
| 2008/0061499 | A1 * | 3/2008 | DeGruchy et al. | 271/273 |

* cited by examiner

*Primary Examiner*—Kaitlin S Joerger
(74) *Attorney, Agent, or Firm*—James J. Ralabate

(57) ABSTRACT

This is a paper registration system that allows for a lateral reset while the paper is present in the nip space. By separating the nips, the carriage can move to reset position for the next sheet while the previous sheet is still present in the carriage.

In addition, the configuration of the system of the invention is reduced or elimination of reaction forces on the carriage lead screw is provided. The registration embodiments of the present system are especially useful in a high speed marking system.

11 Claims, 4 Drawing Sheets

REGISTRATION CARRIAGE NIP RELEASE WITH REDUCED REACTION FORCES

This invention relates to a marking system and, more specifically, to a paper registration structure and system.

BACKGROUND

While the present invention can be used in any suitable marking system, it will be described herein for clarity as used in electrostatic marking systems such as electrophotography or xerography.

By way of background, in marking systems such as xerography or other electrostatographic processes, a uniform electrostatic charge is placed upon a photoreceptor belt or drum surface. The charged surface is then exposed to a light image of an original to selectively dissipate the charge to form a latent electrostatic image of the original. The latent image is developed by depositing finely divided and charged particles of toner upon the belt or drum photoreceptor surface. The toner may be in dry powder form or suspended in a liquid carrier. The charged toner, being electrostatically attached to the latent electrostatic image areas, creates a visible replica of the original. The developed image is then usually transferred from the photoreceptor surface to an intermediate transfer belt or to a final support material such as a paper sheet. When the paper is fed to the system from a paper stack of a feeder mechanism, some papers could be off the home position by many mm and these fed paper sheets need to be deskewed and laterally registered option (1) into position prior to placement on the transport belt or option (2) into position before contacting the image on the photoconductive surface. This is necessary because as the sheets move to the transfer station and approach the imaged photoconductor surface, they need to be in perfect alignment with the toned image on the photoconductive layer for proper image transfer to the sheet to take place.

Thus in a prior art system, the registration carriage moves cross process to perform the lateral registration. There are two issues with this type of design. First, the nips do not separate so the carriage lateral reset must be postponed until there is no paper present (intercopy gap). This reduces the extensibility of the design since the carriage must move only during the intercopy gap. Second, the prior art as implemented allows for the nip forces to produce a non-beneficial reaction force on the lateral move lead screw. The idler nips are loaded against the drive rollers and the nip force is directed perpendicular to the lateral motion. As the nip forces are increased, the load on the lateral registration mechanism is increased causing higher loads at the motor. These forces limit the headroom of the motor system and limit the accelerations possible.

As the paper sheet continues down the transport path, a number of sensors evaluate the positioning of the sheet and convey this information to a controller that will instruct the structure of the present invention on how and when to laterally register the sheet before it reaches the imaged photoconductive surface for image transfer to the sheet. In high speed marking systems, reaction and action time is important. Some prior art registration systems are too slow to be useful in today's high speed systems. Currently, these prior art systems utilize a nip that does not open. This creates an issue that, after its translation of a sheet in the cross process direction, its return to its home position must wait until the sheet leaves the nip. This return must occur in the inter-document zone between the first sheet and the next.

This invention includes amongst others two significant advantages. One is the separation of nips to allow for a lateral reset while the paper is present in the nip space. By separating the nips, the carriage can move to the reset position for the next sheet while the previous sheet is still present at the carriage. This enables higher throughput to be achieved which is extremely important in today's high speed marking systems. The second advantage is the use of a carriage that includes the idler nips and drive nips in a rigid structure. The nip load is then separated from the mechanism controlling lateral motion. As the nip load is applied, no corresponding reaction force is applied to the carriage lead screw or translating system. The reaction load is eliminated and the force/torque required to move the carriage is minimized. This allows for lower torque requirements and improved acceleration rates.

SUMMARY

It is provided in this invention to open the nip. This allows extensibility for the system for higher speeds where shorter inter-document times would mean very high carriage return speeds and acceleration. The invention applies load within the system and also a rigid structure for the idler such that the idler system moves with the carriage not just the idler shaft as in prior art systems. In addition, embodiments of this invention provide a structure where the upper portion of the carriage is separable from the bottom portion without disturbing the relationship of the idler and drive rollers. This is important to unlock the carriage and open it for easy paper jam clearance.

The first of the two advantages of this invention summarized above includes a nip release mechanism for a translating registration system that allows for the system to do a reset while the sheet is passing through the translating nip. This eliminates the need as in the prior art to do the lateral reset only during the intercopy gap and allows for a longer reset time. The longer the reset time, the lower the required acceleration. Reduced accelerations allow for more headroom in the motor drive systems.

The second of the two advantages can be used with either a solid nip or a nip release configuration. This involves connecting the idler nip assembly to the drive nip assembly in a structure that eliminates the drag forces created by having the system separated as it is currently done. The reaction forces caused by the nip loads translate into higher frictional loads on the system. Higher frictional loads lead to higher torque requirements for the motor.

If the structure that contains the idler nip is rigidly attached to the carriage that contains the drive roller, the nip force is not translated to the carriage translation. No additional sliding friction is introduced. Also, no additional lateral backlash is added to the nip idlers due to the linkage design used in prior art from the nip idler shaft to the drive roller carriage.

For example, in a prior art registration system, the carriage which contains the drive rolls and the process direction motors is moved laterally by a lead screw. The nip rolls are part of the upper baffle. The idlers are spring loaded so that when the upper baffle is closed the idlers are put in contact with the drive rolls with a force caused by the deflection of the springs when the rolls form a nip. The nip idler roller shaft is connected to the carriage at the back of the system. This connection is not constrained in the y axis (up and down) to allow for free motion of the idlers and to allow for the nip force. It is constrained (with some movement/backlash as explained above) in the z direction (inboard/outboard) to the carriage to allow the motion of the carriage to drive idlers.

When the carriage translates, the carriage puts a lateral force on the idler shaft so that the idlers track with the drive rollers. The problem here is that the nips do not have a release mechanism to move the idlers off of the drive rolls. When the lead edge of the sheet has come into contact with the photoconductor surface, the carriage cannot move back to meet the next sheet until the sheet currently in its nip is completely out of the nips.

Again, the nip forces applied in the prior art are applied directly to the drive rollers. The nip rollers apply the force from outside the system so there is a reaction force on the lead screw and the translation components. This adds a load to the system that must be compensated for by more torque. The present invention completely eliminates this additional load. This improves the setup and allows in a specific application for a tighter lead screw nut setting to reduce backlash in the system as well. In addition, as mentioned earlier, the prior art has an additional contributor to lateral backlash because the idler shaft is a loose connection to the carriage to enable jam clearance. (See FIG. 3)

The FIGS. 1A and 1B show that the concept would be rigid for the translating portion of registration but could be articulated for jam access/clearance. The FIGS. 1A and 1B show each idler nip with a torsion spring for simplicity in conveying the idea. The idlers could be loaded in different configuration including a single load for both idlers. Also, the nip release could be done by pivoting around the z axis rather than the x axis as shown.

DETAILED DISCUSSION OF DRAWINGS AND PREFERRED EMBODIMENTS

Figure 1A:
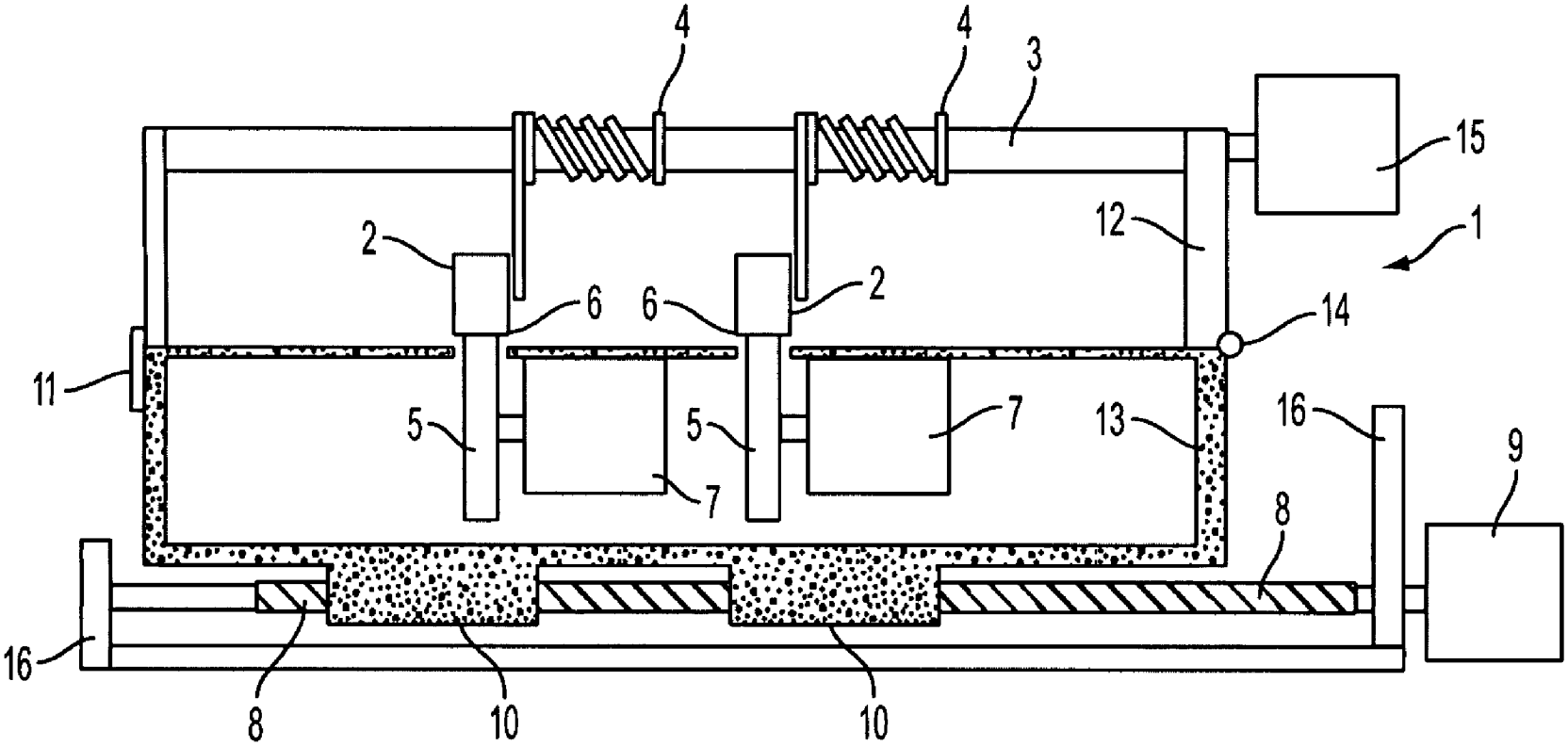
FIG. 1A is a plan view of an embodiment illustrating the carriage and its components before it is moved to laterally register a sheet.

In FIG. 1A, the carriage 1 comprises idler rollers 2 positioned on an idler shaft 3 with springs 4 configured to apply pressure on idler rollers 2. The idler rollers 2 are combined with drive rollers 5 to provide a nip 6 there between. The drive rollers 5 are powered by drive motors 7. The nips 6 are separable; by separating the nips 6 the carriage 1 can move to the reset position for the next sheet while the previous sheet is still present in the carriage 1. This reduces the time required to reset the nips 6 and enables higher sheet throughput to be achieved. The idler rolls 2 and drive rolls 5 are in a rigid structure; thereby as the nip load is applied, no corresponding reaction force is applied to the carriage lead screw 8 or translating system.

The reaction load is eliminated because of this rigid structure and the force/torque required to move the carriage 1 is substantially minimized. The nip release system allows the system to do a reset while a sheet is passing through the translating nip. The prior art could not do a reset until the paper is released by the nips because the nips do not separate and hold the paper until released to the photoconductor.

Since the idler rolls 2 are in a rigid connection to the carrier 1, pressure applied to the nips 6, no corresponding reaction force is applied to the lead screw 8 of the carriage. In the prior art, as the nip forces are increased, the load on the lead screw 8 is increased causing higher loads on the motor 9. The bottom portion 10 of the carrier 1 is screw threaded-movable over lead screw 8 to enable lateral movement of the carriage 1. A latch 11 securely locks the idler rollers 2 in position. The latch 11 is located on one end of the carriage 1 while on the opposite end of the carrier 1 is located a pivot 14 to permit separation of carriage upper portion 12 and carrier lower portion 13; see FIG. 2.

Figure 1B:
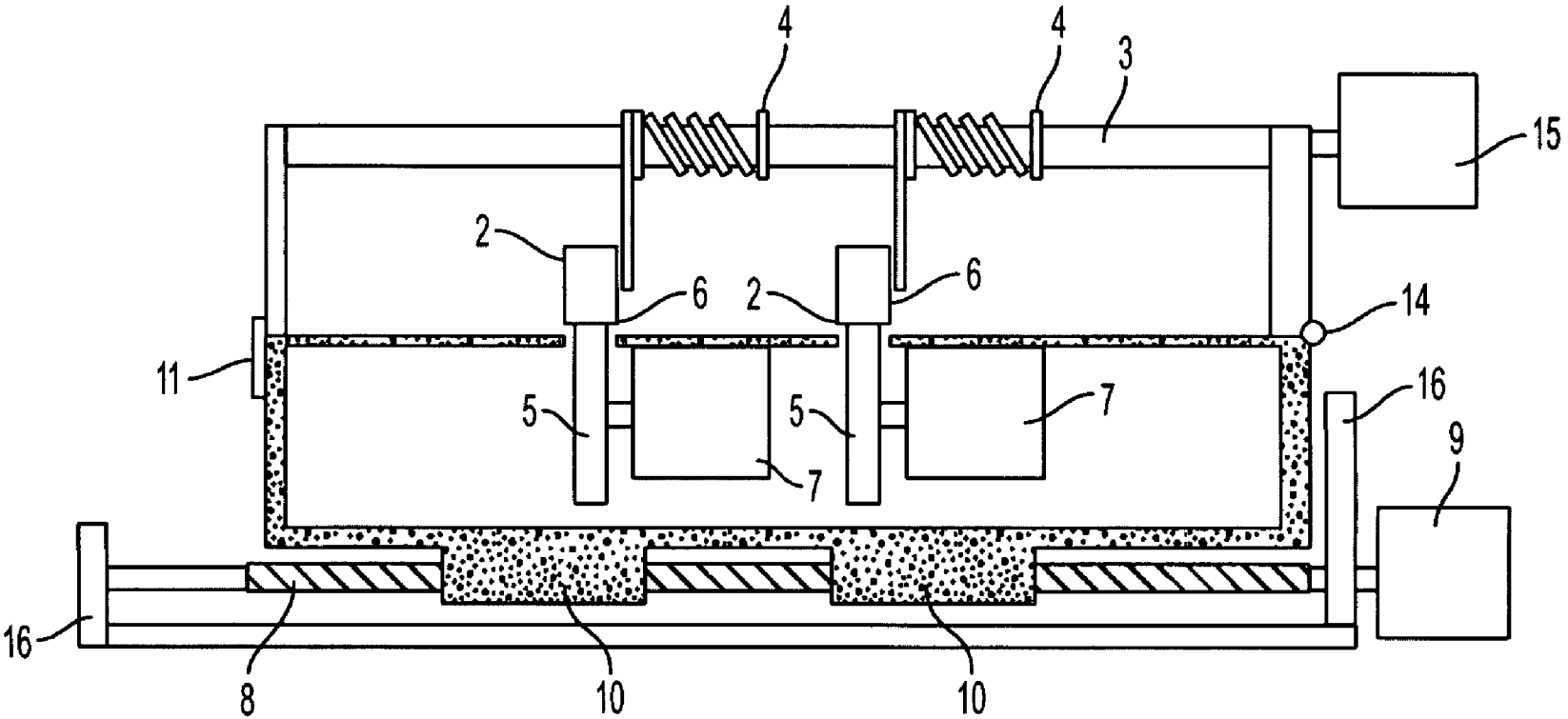
FIG. 1B is this same carriage after it has been moved during a sheet lateral move.

When the carriage 1 is moved during the lateral movement, the structure changes to that of FIG. 1B. Note in 1B that the carriage is much closer on the right hand side to the upper support of lead screw support 16. The carriage 1 is movable when the sensors sense a paper that is offset and needs realignment before contacting the image on a photoconductor surface (not shown). The nips 6, when the carriage 1 is moved, can be opened or closed depending upon the paper realignment required.

Figure 2:
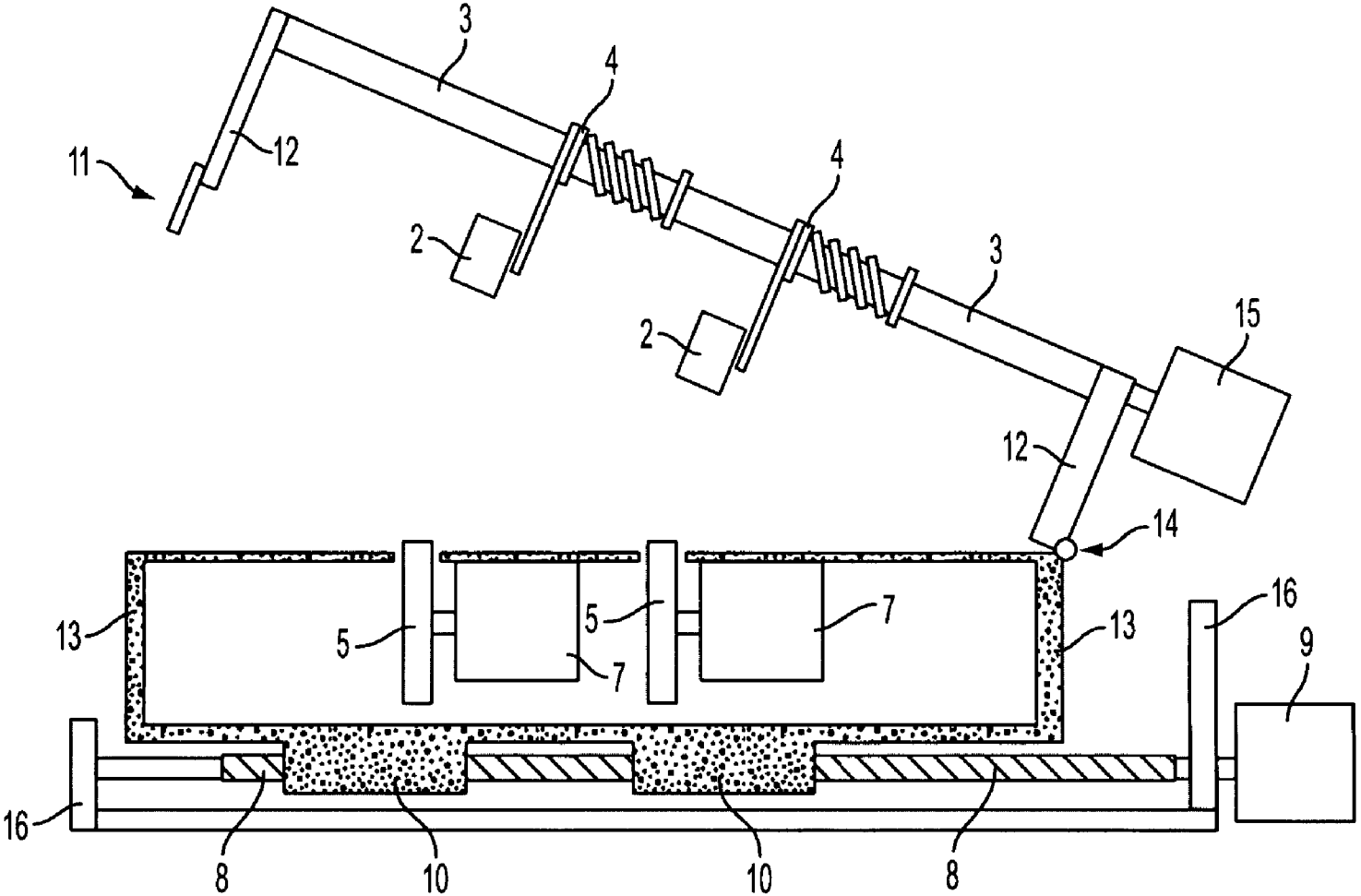
FIG. 2 is an embodiment where the top portion of the carriage has been separated from the bottom carriage portion for paper jam clearance.

When a paper jam occurs, the carriage 1 can be unlocked (the upper and lower portions) and opened for paper jam clearance. This feature is shown in FIG. 2 where the pivot 14 permits this nip separation which was not available in the prior art system.

Figure 3:
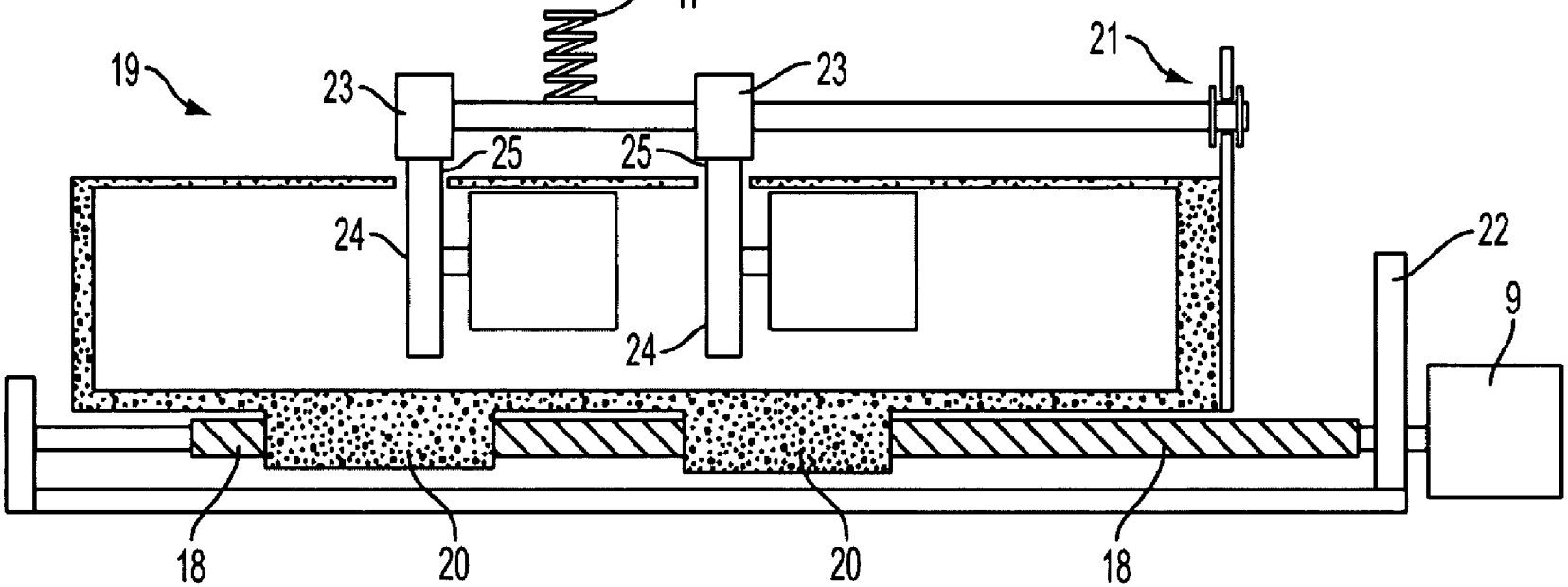
FIG. 3 PRIOR ART
FIG. 3 illustrates a typical prior art carriage used in a paper registration.

In FIG. 3, a typical prior art paper registration system is illustrated where a nip force that acts through spring 17 to the nip rollers also acts onto the lead screw 18 through the carriage 19. This could damage the lead screw 18 or at least interfere with proper movement of the bottom 20 of carriage 19 along the lead screw 18. The end connection 21 of the carriage does not resist nip reaction force but rather translates only lateral forces. The drive rollers 24 and idler roller 23 form nips 25 that are not separable. Since the nips 25 do not separate, the carriage 19 lateral reset must be postponed until there is no paper present (the intercopy gap). Also, the prior art system of FIG. 3 allows for the nip 25 forces to produce a non-beneficial reaction force on the lateral movable lead screw 18.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A paper registration system comprising:

a translating carriage comprising therein, at least two drive rollers, at least two idler rollers, motors to drive said drive rollers, and a movable carriage lead screw and motor to permit lateral movement of said carriage, said drive rollers and said idler rollers in movable and separable contact to form separable nips there between, said separable nips configured to allow for a lateral paper reset while said paper is present in a nip space, said idler and driver rollers rigidly connected to said carriage in a locked position such that said rollers move in accordance with and to the extent of said carriage movement, and wherein said carriage has a pivotable top portion comprising said idler rollers, a shaft for said idler rollers and a motor connected to said shaft.

2. The system of claim 1 wherein said nips are separable, thereby said carriage is enabled to move to a reset position for a next sheet while a previous sheet is still present in the carriage.

3. The system of claim 1 wherein said idler rollers are connected to a spring(s), said spring enabled to exert a nip load upon a paper sheet moving therein.

4. The system of claim 1 wherein one spring is connected to said nips and is enabled to exert pressure thereon.

5. The system of claim 1 wherein at least two springs are connected to said nips and are enabled to exert pressure thereon.

6. The system of claim 1 wherein a bottom portion of said carriage is movably connected to a lead screw and a lead screw motor, said carriage configured to move along a length of said lead screw.

7. The system of claim 1 wherein said carriage has a lower portion separably connected to a pivotable top portion, said lower portion comprising said drive rollers, motors to impart motion to said drive rollers, and a lead screw movably connected to said lower portion.

8. The system of claim 1 wherein said carriage has a separable top portion and lower portion, said top portion and said lower portion having on one first end thereof a pivot structure upon which said top and lower portions move when separated and said carriage having on a second opposite end portion a latch configured to lock and unlock said top and lower portions.

9. A paper registration system useful in an electrostatic marking system comprising:

a translating carriage comprising therein;

at least two drive rollers, at least two idler rollers, motors to drive said drive rollers, and a movable lead screw and motor to permit lateral movement of said carriage, said drive rollers and said idler rollers in movable and separable contact to form separable nips there between, said separable nips configured to allow for a lateral paper reset while said paper is present in a nip space, said idler and driver rollers rigidly connected to said carriage in a locked position such that said rollers move in accordance with and to the extent of said carriage movement, said idler rollers and said drive rollers are secured in said carriage in a rigid structure and configured as a nip load is applied that no corresponding reaction force is applied to said movable lead screw, said rigid structure enabled to substantially reduce any adverse effect upon movement of said carriage lead screw and said carriage, and wherein said carriage has a pivotable top portion comprising said idler rollers, a shaft for said idler rollers and a motor connected to said shaft.

10. The system of claim 9 wherein said carriage has a lower portion connected to a pivotable top portion, said lower portion comprising said drive rollers, motors to impart motion to said drive rollers, and a lead screw movably connected to said lower portion.

11. The system of claim 9 wherein said carriage has a separable top portion and lower portion, said top portion and said lower portion having on one first end thereof a pivot structure upon which said top and lower portions move when separated and said carriage having on a second opposite end portion a latch configured to unlock said top and lower portion.

* * * * *